US009333545B2

(12) United States Patent
Fujiwara

(10) Patent No.: US 9,333,545 B2
(45) Date of Patent: May 10, 2016

(54) METHOD OF DETECTING FAULT IN PIERCING-ROLLING AND METHOD OF PRODUCING SEAMLESS PIPE OR TUBE

(75) Inventor: Masakazu Fujiwara, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 464 days.

(21) Appl. No.: 13/882,743

(22) PCT Filed: Nov. 1, 2011

(86) PCT No.: PCT/JP2011/075148

§ 371 (c)(1),
(2), (4) Date: Jul. 8, 2013

(87) PCT Pub. No.: WO2012/060358

PCT Pub. Date: May 10, 2012

(65) Prior Publication Data

US 2013/0276498 A1 Oct. 24, 2013

(30) Foreign Application Priority Data

Nov. 2, 2010 (JP) ..... 2010-246168

(51) Int. Cl.

| | |
|---|---|
| ***B21B 37/78*** | (2006.01) |
| ***B21B 19/04*** | (2006.01) |
| ***B21C 51/00*** | (2006.01) |
| *B21B 38/00* | (2006.01) |
| *B21B 38/08* | (2006.01) |

(52) U.S. Cl.

CPC ..... *B21B 37/78* (2013.01); *B21B 19/04* (2013.01); *B21C 51/00* (2013.01); *B21B 38/00* (2013.01); *B21B 38/08* (2013.01); *B21B 2265/12* (2013.01)

(58) Field of Classification Search

CPC ..... B21B 19/04; B21B 37/78; B21B 38/08; B21B 2265/12; B21C 51/00

See application file for complete search history.

(56) References Cited

U.S. PATENT DOCUMENTS 4,006,618 A * 2/1977 Yanagimoto ..... B21B 23/00 72/11.3
4,190,887 A * 2/1980 Yoshiwara ..... B21B 17/08 700/151

FOREIGN PATENT DOCUMENTS

| | | |
|---|---|---|
| JP | 10-180311 | 7/1998 |
| JP | 2000-000605 | 1/2000 |
| JP | 2000-246311 | 9/2000 |
| JP | 2000-334506 | 12/2000 |
| JP | 2001-162307 | 6/2001 |
| JP | 2002-192229 | 7/2002 |

* cited by examiner

*Primary Examiner* — Debra Sullivan
(74) *Attorney, Agent, or Firm* — Clark & Brody

(57) ABSTRACT

The object is to provide a method of detecting a fault which ensures high-accuracy detection of a fault in piercing-rolling. A piercing-rolling mill (10) is provided with piercer rolls (1*a*, 1*b*), a piercer plug (3), a rolling load sensor (4), a thrust load sensor (5), and a control device (6). The control device (6) measures a rolling load parameter corresponding to the rolling load of the piercer rolls (1*a*, 1*b*) and a thrust load parameter corresponding to the thrust load of the piercer plug (3), and detects a fault in piercing-rolling on the basis of a measured value of the rolling load parameter and a measure value of the thrust load parameter.

2 Claims, 4 Drawing Sheets

METHOD OF DETECTING FAULT IN PIERCING-ROLLING AND METHOD OF PRODUCING SEAMLESS PIPE OR TUBE

TECHNICAL FIELD

The present invention relates to a method of detecting a fault in piercing-rolling occurring during the piercing-rolling of a billet using piercer rolls and a method of producing a seamless pipe or tube. Specifically, the present invention relates to a method of detecting a fault in piercing-rolling which enables a fault in piercing-rolling to be easily detected and a method of producing a seamless pipe or tube including a step of detecting a fault by this method.

BACKGROUND ART

In the production of seamless tube by the Mannesmann-mandrel mill process, first, a billet, which is a starting material, is heated to 1200 to 1260° C. in a heating furnace and after that, in the piercing-rolling process a hollow shell is produced by performing piercing-rolling using a piercer plug and the piercer rolls of a piercing-rolling mill. Next, a mandrel bar is inserted along the inner surface of the above-described hollow shell and elongation rolling is performed on a mandrel mill usually consisting of 5 to 8 stands by constraining the outer surface with grooved rolling rolls, whereby the thickness is reduced to a prescribed wall thickness and a material pipe or tube is produced. After that, the mandrel bar is extracted from the material pipe or tube and this material pipe or tube is sized on a sizing mill to a prescribed outside diameter to obtain a seamless pipe or tube as a product.

FIGS. 1A and 1B are diagrams showing an example of the schematic construction of a piercing-rolling mill. FIG. 1A is a side view and FIG. 1B is a plan view. FIG. 2 is a diagram showing an approximate positional relationship among the piercer roll, the piercer plug, and the billet. The illustration of the piercer plug is omitted in FIG. 1B, and for the sake of simplicity, the feed angle and toe angle of a pair of piercer rolls are set at 0 in FIG. 1B. As shown in FIGS. 1A and 1B, a piercing-rolling mill 10 is provided with a pair of piercer rolls 1*a*, 1*b* and a bullet-like piercer plug 3 whose rear end is supported by a mandrel 2. The pair of piercer rolls 1*a*, 1*b* are set in such a manner that the axial directions thereof are parallel to each other as viewed from the side or cross at a prescribed toe angle (in FIG. 1A, only the case where the piercer rolls are set parallel to each other is shown). On the other hand, the piercer rolls are disposed in such a manner that the two are inclined at a feed angle θ in directions reverse to each other as viewed from the plane and are configured to rotate in the same direction. The piercer plug 3 is disposed between the pair of piercer rolls 1*a*, 1*b*.

In order to piercing-rolling a solid billet B using the piercing-rolling mill 10 having this configuration, first, the billet B is fed to between the pair of piercer rolls 1*a* and 1*b*. After the billet B is gripped by the pair of piercer rolls 1*a*, 1*b* the force with which the billet B is rotated by the frictional force of the piercer rolls 1*a*, 1*b* and the force with which the billet B is moved forward in the axial direction act simultaneously on the billet B. And until the billet B reaches the front end of the piercer plug 3, a compressive stress and a tensile stress act alternately continuously on the central part of the billet B (the rotary forging effect) and an opening becomes tend to be formed. When the billet B abuts against the piercer plug 3, a hole is made in the central part of the billet B and the billet B is thereafter subjected to wall-thickness working between the piercer rolls 1*a*, 1*b* and the piercer plug 3, whereby a hollow shell S is obtained.

In such piercing-rolling, many faults occur at the start of rolling when the billet B is gripped by the piercer rolls 1*a*, 1*b* and rolling is started and when the rolling is finished and the rolled hollow shell S leaves the piercing-rolling mill 10. There are mainly the following two kinds of faults as faults occurring in piercing-rolling at the start of rolling.

In one fault, a fed billet B is not gripped by the piercer rolls 1*a*, 1*b* and does not abut against with the piercer plug 3 although the billet B comes into contact with the piercer rolls 1*a*, 1*b*. Hereinafter, this fault is called a slippage fault.

In another fault, the speed of the entry of the billet B into the piercer rolls 1*a*, 1*b* is slow or the entry stops although the billet B is gripped by the piercer rolls 1*a*, 1*b* and abuts against the piercer plug 3, and the rolling load of the piercer rolls 1*a*, 1*b* increases only gently after the billet B abuts against the piercer plug 3. Hereinafter, this fault is called a head jam fault.

Examples of manufacturing conditions for preventing the occurrence of such faults at the start of piercing-rolling include increasing the draft rate, which expresses the degree of gripping by the piercer rolls 1*a*, 1*b*. However, if the draft rate is made too high, an inner surface shell flaw (a flaw occurring on the inner surface of the shell) may occur.

The draft rate is defined as follows (see FIG. 2):

$$\text{Draft rate}=(d-r)/d\times 100$$

where d is the outside diameter of the billet, and r is the gap between the piercer roll 1*a* and the piercer roll 1*b* at the place where the leading end of the billet abuts against the piercer plug 3.

Examples of manufacturing conditions for preventing the occurrence of faults at the start of piercing-rolling include increasing the coefficient of friction with the billet B by applying an antislipping agent to the surfaces of the piercer rolls 1*a*, 1*b*. However, if the application of the antislipping agent is continued, an outer surface shell flaw (a flaw occurring on the outer surface of the shell) may occur due to the roughness of the piercer roll surface, and operation troubles may occur due to, for example, the entry of the antislipping agent into the bearings of the driving device (not shown) which rotates the piercer rolls 1*a*, 1*b*.

It is desirable to increase the opening of the piercer rolls 1*a*, 1*b* as a measure to be taken when a slippage fault has occurred, whereas as a measure to be taken when a head jam fault has occurred, it is desirable to reduce the opening of the piercer rolls 1*a*, 1*b* in the case of a billet B made of an ordinary steel and to apply an antislipping agent to the piercer rolls 1*a*, 1*b* in the case of a billet B made of a high-alloy steel.

However, for example, in the case where the billet B is made of a high-alloy steel containing not less than 2 mass % of Cr, the appropriate range of the draft rate is very narrow and, therefore, it is difficult to avoid faults in piercing-rolling. Also in the case where the billet B is made of a carbon steel, the rolling condition changes according to the condition of rough piercer roll surfaces and the like and, therefore, it is difficult to avoid faults in piercing-rolling.

If such faults in piercing-rolling occur, in the worst case piercing-rolling is stopped and all billets B present in the production line from the heating furnace to the piercing-rolling mill 10 must be taken out of the line, causing great damage. For this reason, in the case where a fault in piercing-rolling occurred, it is desirable to immediately detect the occurrence of the fault and to take measures.

However, the detection of these faults in piercing-rolling is visually carried out by skilled workers and is influenced by the skill of the workers, posing the problem that the accuracy of detection is low.

There are also known methods of detecting a fault in piercing-rolling which involve making a judgment that a slip has occurred between the piercer rolls and the billet and detecting a fault in piercing-rolling if during piercing-rolling the current value of motors driving the piercer rolls becomes lower than a prescribed threshold value (refer to Patent Literature 1, for example).

However, with this detection method, it is impossible to detect faults at the start of piercing-rolling as described above.

CITATION LIST

Patent Literature

[Patent Literature 1]
JP10-180311

SUMMARY OF INVENTION

Technical Problem

The present invention was made in order to solve such problems with conventional techniques, and the object thereof is to provide a method of detecting a fault which ensures high-accuracy detection of a fault in piercing-rolling.

Solution to Problem

In order to solve the above-described problems, the present inventors studied a method of detecting a fault in piercing-rolling with high accuracy using various parameters obtained in piercing-rolling. As a result, they obtained the finding that it is possible to perform the detection of a fault in piercing-rolling with high accuracy by using both a rolling load parameter corresponding to a rolling load (a load applied to the piercer rolls) and a thrust load parameter corresponding to a thrust load (a load applied to the piercer plug).

The rolling load parameter corresponding to a rolling load is a parameter having a correlation to the rolling load, and is, for example, the current value of motors driving the piercer rolls and the rolling load itself. The thrust load parameter corresponding to a thrust load is a parameter having a correlation to the thrust load and is, for example, the thrust load itself.

The present invention has been achieved based on the above finding of the present inventors. That is, in order to solve the above-described problems, the present invention provides a method of detecting a fault in piercing-rolling when a billet is piercing-rolled using piercer rolls and a piercer plug, the method comprising: measuring a rolling load parameter corresponding to the rolling load of the piercer rolls and a thrust load parameter corresponding to the thrust load of the piercer plug; and detecting a fault in piercing-rolling on the basis of a measured value of the rolling load parameter and a measured value of the thrust load parameter.

According to the present invention, the accuracy of detection of a fault in piercing-rolling is high because a rolling load parameter and a thrust load parameter are measured and a fault in piercing-rolling is detected on the basis of both a measured value of the rolling load parameter and a measured value of the thrust load parameter.

Preferably, it is judged that a fault (concretely a slippage fault) in piercing-rolling has occurred in the case where the measured value of the thrust load parameter does not exceed a first threshold value of thrust, after the billet is gripped by the piercer rolls, by the time a first prescribed time elapses after the measured value of the rolling load parameter exceeds for the first time a first threshold value of rolling.

The first threshold value of rolling used here is a first threshold value related to the rolling load parameter and is a threshold value for making a judgment as to whether the billet has come into contact with the piercer rolls.

The first threshold value of thrust used here is a first threshold value related to the thrust load parameter and is a threshold value for making a judgment as to whether the leading end of the billet has abutted against the piercer plug.

According to this preferable method, it is judged that the billet has come into contact with the piercer rolls when the measured value of the rolling load parameter exceeds for the first time a first threshold value of rolling, which is fixed beforehand, and it is judged that the leading end of the billet has abutted against the piercer plug when the measured value of the thrust load parameter exceeds a first threshold value of thrust.

Therefore, it is possible to judge with high accuracy that a slippage fault has occurred in the case where the measured value of the thrust load parameter does not exceed a first threshold value of thrust, by the time a first prescribed time elapses after the measured value of the rolling load parameter exceeds for the first time a first threshold value of rolling.

Preferably, it is judged that a fault (concretely a head jam fault) in piercing-rolling has occurred in the case where the measured value of the rolling load parameter does not exceed a second threshold value of rolling, after the billet is gripped by the piercer rolls, by the time a second prescribed time elapses after the measured value of the thrust load parameter exceeds for the first time a second threshold value of thrust.

The second threshold value of thrust used here is a second threshold value related to the thrust load parameter and is a threshold value for making a judgment as to whether the leading end of the billet has come into contact with the piercer plug as with the first threshold value of thrust. Therefore, the same value as the first threshold value of thrust can be used. However, a value different from the first threshold value of thrust may be used so long as this value is in the range in which the purpose of making a judgment as to whether the leading end of the billet has abutted against the piercer plug is accomplished.

The second threshold value of rolling is a second threshold value related to the rolling load parameter and is a threshold value for making a judgment as to whether the billet is being normally rolled by the piercer rolls and the piercer plug after the leading end of the billet abuts against the piercer plug.

According to this preferable method, it is judged that the billet has abutted against the piercer plug when the measured value of the thrust load parameter exceeds for the first time a second threshold value of thrust, and it is judged that the billet is being normally rolled by the piercer rolls and the piercer plug when the measured value of the rolling load parameter exceeds the second threshold value of rolling.

Therefore, it is possible to judge with high accuracy that a head jam fault has occurred in the case where the measured value of the rolling load parameter does not exceed a second threshold value of rolling, by the time a second prescribed time elapses after the measured value of the thrust load parameter exceeds for the first time a second threshold value of thrust.

Also, the present invention provides a method of producing a seamless pipe or tube by using piercing-rolling, comprising the steps of: detecting a fault in piercing-rolling by any of the above-described methods; and improving conditions in piercing-rolling when the fault is detected.

According to the present invention, conditions in piercing-rolling is improved when a fault in piercing-rolling is detected, therefore, it is possible to produce a seamless pipe or tube freely from a fault in piercing-rolling.

Advantageous Effect of Invention

According to the present invention, the accuracy of detection of a fault in piercing-rolling is high because a rolling load parameter and a thrust load parameter are measured and a fault in piercing-rolling is detected on the basis of both a measured value of the rolling load parameter and a measured value of the thrust load parameter.

BRIEF DESCRIPTION OF DRAWINGS

FIG. 1A is a side view and FIG. 1B is a plan view.

DESCRIPTION OF EMBODIMENT

Figure 3:
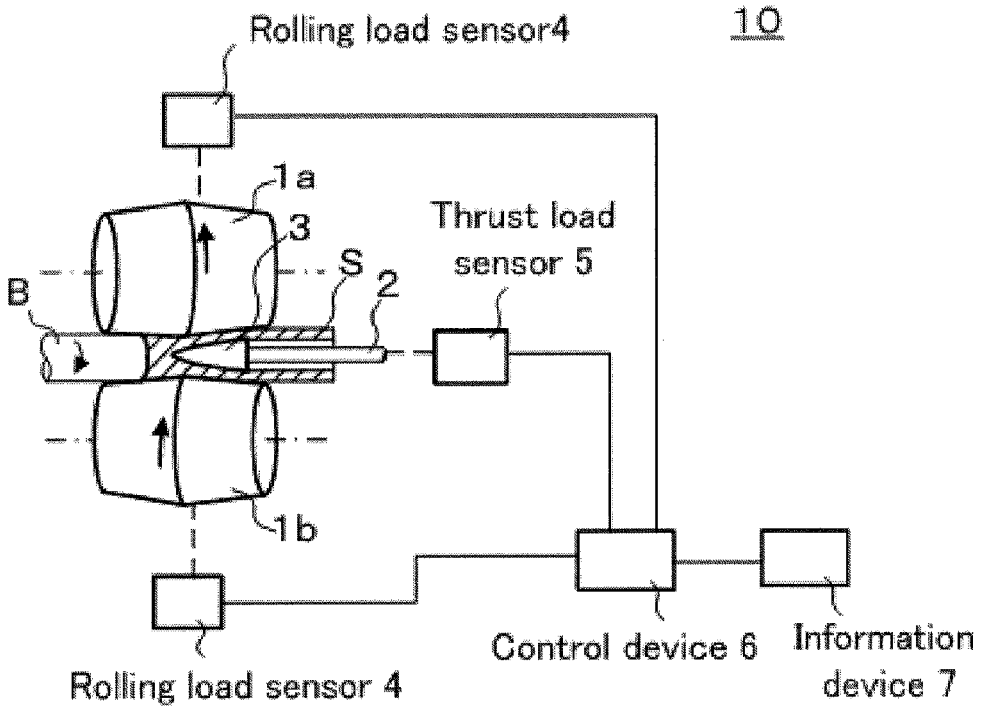
FIG. 3 is a schematic bloc diagram showing a piercing-rolling mill in which the method of detecting a fault in piercing-rolling of the present invention is used.

Referring to the accompanying drawings as appropriate, a description will be given of the method of detecting a fault in piercing-rolling in an embodiment of the present invention. FIG. 3 is a schematic bloc diagram showing a piercing-rolling mill 10 in which the method of detecting a fault in piercing-rolling of the present embodiment is used.

Figure 1A:
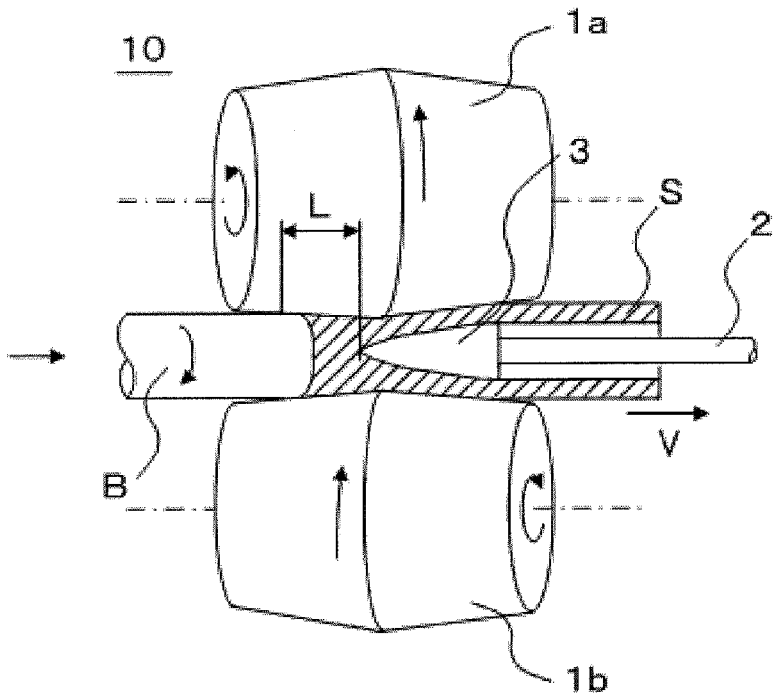
FIGS. 1A and 1B are diagrams showing an example of the schematic construction of a conventional piercing-rolling mill.
Figure 1B:
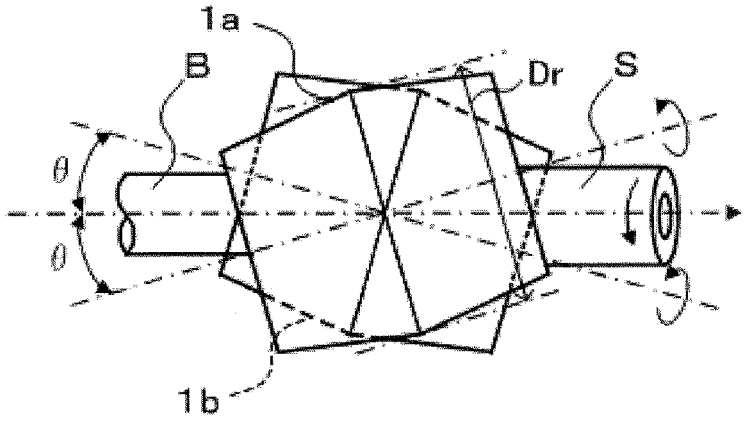

The piercing-rolling mill 10 is provided with a rolling load sensor 4, a thrust load sensor 5, a control device 6, and an information device 7 in addition to the components described in FIGS. 1A and 1B. The rolling load sensor 4, which is, for example, a load cell, measures the rolling load of the piercer rolls 1*a*, 1*b* and transmits an electrical signal corresponding to a measured value of rolling load to the control device 6. The thrust load sensor 5, which is, for example, a load cell, measures the thrust load of the piercer plug 3 and transmits an electrical signal corresponding to a measured value of thrust load to the control device 6. The control device 6 detects a fault in piercing-rolling on the basis of electrical signals from the rolling load sensor 4 and the thrust load sensor 5. The information device 7 provides information about the occurrence of a fault in piercing-rolling by a signal from the control device 6. The information device 7 is, for example, a display screen of liquid crystal and the like, and a buzzer which sounds.

Next, a description will be given of a method of detecting a slippage fault among faults in piercing-rolling.

Figure 4:
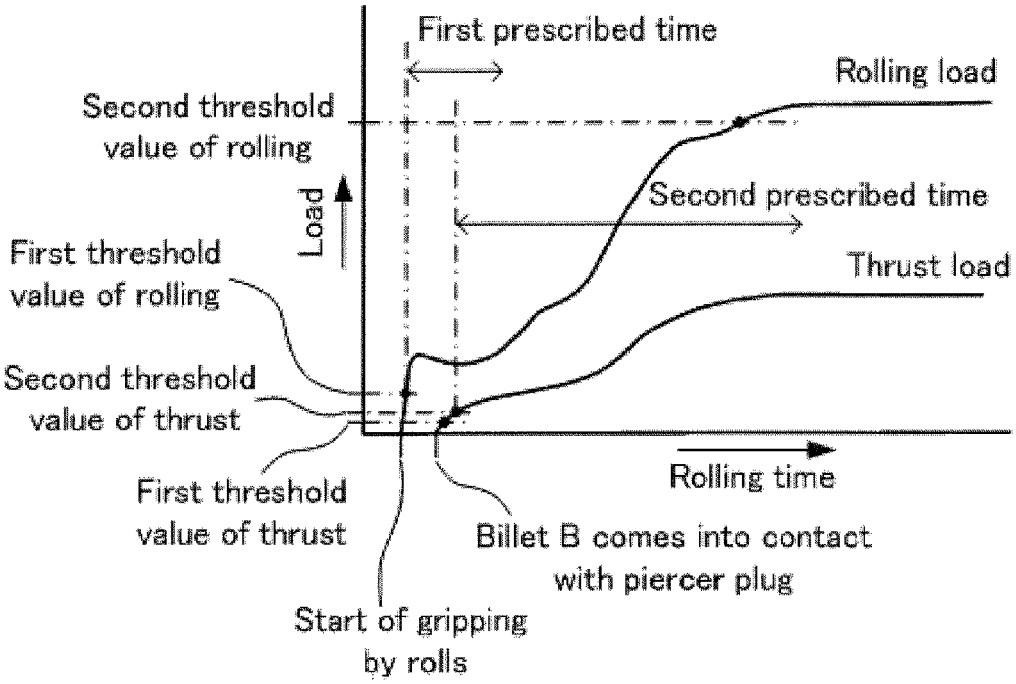
FIG. 4 is a diagram showing changes in a rolling load and a thrust load at the start of piercing-rolling.

FIG. 4 shows changes in a rolling load and a thrust load at the start of piercing-rolling.

In the case where piercing-rolling is performed normally, a billet B is fed to between a pair of piercer rolls 1*a*, 1*b* and abuts against a piercer plug 3 within a prescribed period of time after the billet B is gripped by the piercer rolls 1*a*, 1*b*. It is judged that a slippage fault has occurred when the billet B does not abut against the piercer plug 3 within a prescribed period of time after being gripped by the piercer rolls 1*a*, 1*b*. Specifically, the judgment is made as follows.

When the billet B is fed by a transfer machine (not shown) to between the pair of piercer rolls 1*a*, 1*b* and is gripped by the piercer rolls 1*a*, 1*b*, the rolling load of the piercer rolls 1*a*, 1*b* increases. The rolling load sensor 4 is measuring the rolling load of the piercer rolls 1*a*, 1*b* and transmits an electrical signal corresponding to a measured value of rolling load to the control device 6. In the control device 6, a first threshold value of rolling is fixed beforehand. When the measured value of rolling load exceeds for the first time the first threshold value of rolling (the measured value of rolling load>the first threshold value of rolling), the control device 6 judges that the billet B has been gripped by the piercer rolls 1*a*, 1*b*. The first threshold value of rolling is a threshold value for making a judgment as to whether the billet B has been gripped by the piercer rolls 1*a*, 1*b* and is fixed by a prior investigation so that the control device 6 does not make a wrong judgment due to noise that the billet B has been gripped by the piercer rolls 1*a*, 1*b* although in reality the billet B was not gripped.

When the control device 6 judges that the billet B has been gripped by the piercer rolls 1*a*, 1*b*, the control device 6 starts counting the first prescribed time.

And it is judged that piercing-rolling has been started normally in the case where the measured value of thrust load transmitted from the thrust load sensor 5 exceeds the first threshold value of thrust (the measured value of thrust load>the first threshold value of thrust) by the time the first prescribed time elapses, whereas it is judged that a slippage fault has occurred in the case where the measured value of thrust load does not exceed the first threshold value of thrust.

The first threshold value of thrust is a threshold value for making a judgment as to whether the leading end of the billet B has abutted against the piercer plug 3 and is fixed by a prior investigation so that the control device 6 does not make a wrong judgment due to noise that the leading end of the billet B has abutted against the piercer plug 3 although in reality the billet B did not abut.

The first prescribed time is fixed to make a judgment as to whether a slippage fault has occurred and is fixed from the period of time until the leading end of the billet B abuts against the piercer plug 3 after the billet B is gripped by the piercer rolls 1*a*, 1*b* in the case where a slippage fault did not occur.

On the basis of the finding from prior investigations that a slippage fault is apt to occur in the case where the billet B does not abut against the piercer plug 3 by the time the billet B rotates three turns after being gripped by the piercer rolls 1*a*, 1*b*, the first prescribed time is fixed, for example, as follows:

$$t1=(d\cdot\pi\cdot 3)/(D\cdot\pi\cdot N)$$

where t1: First prescribed time (second)

d: Outside diameter of billet B (mm)

D: Outside diameter of piercer rolls 1*a*, 1*b* in the position where the piercer rolls 1*a*, 1*b* gripped the billet B (mm)

Figure 2:
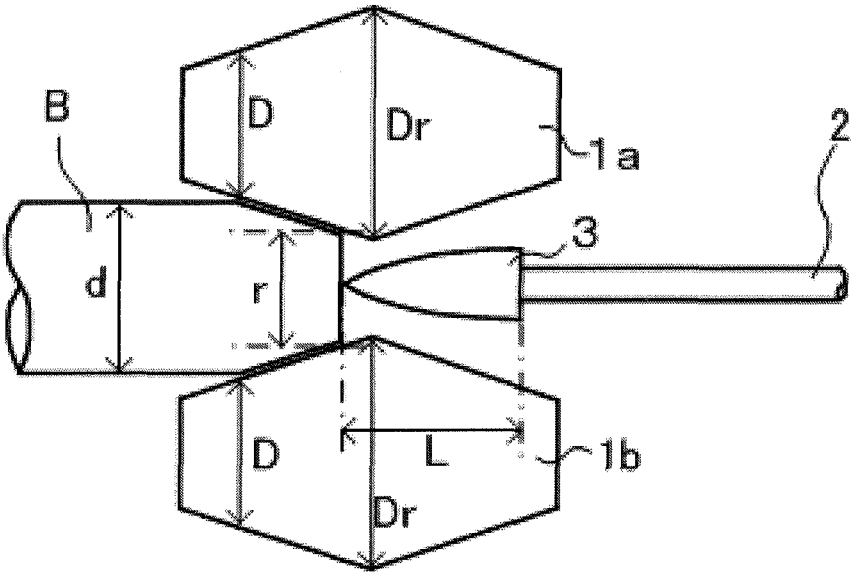
FIG. 2 is a diagram showing an approximate positional relationship among the piercer roll, the piercer plug, and the billet.

N: Number of rotations of piercer rolls 1*a*, 1*b* per second (see FIG. 2).

When the control device 6 judges that a slippage fault has occurred, the control device 6 causes the information device 7 to provide information on the occurrence of the slippage fault.

The accuracy of detection of a fault in piercing-rolling is high because as described above, a rolling load parameter and a thrust load parameter are measured and a fault in piercing-rolling is detected on the basis of both a measured value of the rolling load parameter and a measured value of the thrust load parameter.

In the above-described example, the occurrence of, in particular, a slippage fault can be detected with high accuracy.

Next, a description will be given of a method of detecting a head jam fault among faults in piercing-rolling.

In the case where piercing-rolling is performed normally, after the leading end of the billet B abuts against the piercer plug 3, the billet B is rolled by the piercer rolls 1*a*, 1*b* and the piercer plug 3. Therefore, the rolling load of the piercer rolls 1*a*, 1*b* increases and the rolling load becomes a maximum when the leading end of the hollow shell S reaches the position of the rear end of the piercer plug 3. After that, the rolling load is held in the vicinity of this maximum value.

Therefore, it is judged that a head jam fault has occurred in the case where the rolling load does not exceed a prescribed value within a prescribed period of time after the billet B abuts against the piercer plug 3. Specifically, the judgment is made as follows.

The thrust load of the piercer plug 3 increases when the leading end of the billet B abuts against the piercer plug 3 after the billet B is gripped by the piercer rolls 1*a*, 1*b*. The thrust load sensor 5 is measuring the thrust load of the piercer plug 3 and transmits an electrical signal corresponding to a measured value of thrust load to the control device 6. In the control device 6, a second threshold value of thrust is set. When the measured value of thrust load exceeds for the first time the second threshold value of thrust (the measured value of thrust load>the second threshold value of thrust), the control device 6 judges that the leading end of the billet B has abutted against the piercer plug 3.

The second threshold value of thrust is a threshold value for making a judgment as to whether the leading end of the billet B has abutted against the piercer plug 3 and is fixed by a prior investigation so that the control device 6 does not make a wrong judgment due to noise that the leading end of the billet B has abutted against the piercer plug 3 although in reality the billet B did not abut. Because as with the first threshold value of thrust, the second threshold value of thrust is a threshold value for making a judgment as to whether the leading end of the billet B has abutted against the piercer plug 3, the same value as the first threshold value of thrust can be used. However, a value different from the first threshold value of thrust may be used so long as this value is in the range in which the purpose of making a judgment as to whether the leading end of the billet has abutted against the piercer plug is accomplished.

The second prescribed time is a time for making a judgment as to whether the rolling load is increasing normally and is fixed to be the same time as the time required until the leading end of the hollow shell S reaches the position of the rear end of the piercer plug 3 after the leading end of the billet B abuts against the piercer plug 3, or a time shorter than this time.

When the control device 6 judges that the billet B has abutted against the piercer plug 3, the control device 6 starts counting the second prescribed time.

And it is judged that the billet B is being rolled normally by the piercer rolls 1*a*, 1*b* and the piercer plug 3 in the case where the measured value of rolling load transmitted from the rolling load sensor 4 exceeds the second threshold value of rolling (the measured value of rolling load>the second threshold value of rolling) by the time the second prescribed time elapses, whereas it is judged that a head jam fault has occurred in the case where the rolling load does not exceed the second threshold value of rolling.

The second prescribed time and the second threshold value are fixed, for example, as follows.

The second prescribed time is defined as the time required until the leading end of the hollow shell S reaches the position of the rear end of the piercer plug 3 after the leading end of the billet B abuts against the piercer plug 3 in the condition in which normal piercing-rolling is being performed. The second threshold value of rolling is a threshold value for making a judgment as to whether the billet B is being normally rolled by the piercer rolls 1*a*, 1*b* and the piercer plug 3 after the leading end of the billet B abuts against the piercer plug 3. The second threshold value of rolling is set at 90% of rolling load occurring when the leading end of the hollow shell S reaches the position of the rear end of the piercer plug 3 in the condition in which normal piercing-rolling is being performed, and the second threshold value of rolling is fixed by a prior investigation. Therefore, in usual cases, the second threshold value of rolling becomes a value larger that the first threshold value of rolling.

Specifically, the second prescribed time is fixed, for example, as follows:

$$t2=L/V$$

where, t2: Second prescribed time (second)

L: Length of piercer plug 3

V: Rolling load at the leading end of hollow shell S (see FIGS. 1A and 1B and FIG. 2).

Where, V is as follows:

$$V=Dr\cdot\pi\cdot N\cdot\sin\theta\cdot 0.5$$

Dr: Maximum diameter of piercer rolls 1*a*, 1*b* (mm)

N: Number of rotations of piercer rolls 1*a*, 1*b* per second (see FIG. 1B).

The peripheral speed of the piercer rolls 1*a*, 1*b* in the place where the outside diameter of the piercer rolls 1*a*, 1*b* is a maximum is calculated, and V is set at 50% of the component constituting this peripheral speed in the axial direction of the hollow shell. In the above-described formulae, the ratio of V to the component constituting the peripheral speed of the piercer rolls 1*a*, 1*b* in the axial direction of the hollow shell can be changed according to rolling conditions.

When the control device 6 judges that a head jam fault has occurred, the control device 6 causes the information device 7 to provide information on the occurrence of the head jam fault.

As described above, the occurrence of head jam fault can be detected with high accuracy.

Next, a description will be given of a method of producing a seamless pipe or tube in which the above-described method of detecting a fault in piercing-rolling is used. This producing method of a seamless pipe or tube includes a step of detecting a fault in piercing-rolling and a step of improving conditions in piercing-rolling when this fault is detected.

In the step of detecting a fault in piercing-rolling, either or both of a detection method of a slippage fault and a detection method of a head jam fault is carried out.

And in the step of improving conditions in piercing-rolling, for example, the contents described below are carried out.

When a slippage fault has occurred, the opening of the piercer rolls 1*a*, 1*b* is increased for a billet B which is being piercing-rolled, and similarly the opening of the piercer rolls 1*a*, 1*b* is increased for the billets B which are to be piercing-rolled after the billet B in question.

When a head jam fault has occurred, in the case of a billet B made of an ordinary steel, the opening of the piercer rolls 1*a*, 1*b* is reduced for the billet B which is being piercing-rolled, whereas in the case of a billet B made of a high-alloy steel, an antislipping agent is applied to the piercer rolls 1*a*, 1*b*. And the same thing is carried out also for the billets B to be piercing-rolled after the billet B in question.

Further, when a slippage fault or a head jam fault has occurred, a draft rate can be corrected for the billets B to be piercing-rolled after the billet B in question.

As described above, when a fault in piercing-rolling is detected, conditions in piercing-rolling are improved, whereby a seamless pipe or tube can be produced freely from faults in piercing-rolling.

For the above-described detection method of a slippage fault and detection method of a head jam fault, either or both of the detection methods may be carried out. If the opening of the piercer rolls 1*a*, 1*b* is made too large when a slippage fault is detected, a head jam fault may occur, whereas if the opening of the piercer rolls 1*a*, 1*b* is made too small when a head jam fault is detected, a slippage fault may occur. Therefore, both the detection method of a slippage fault and the detection method of a head jam fault are carried out and the opening between the piercer rolls 1*a* and 1*b* is adjusted so that neither a slippage fault nor a head jam fault occurs, whereby it is possible to make adjustments to an appropriate opening.

The present invention is not limited to the configuration of the above-described embodiment, and various modifications are possible so long as the gist of the present invention is not changed thereby. For example, although in the above-described embodiment, the second threshold value of rolling is set at 90% of rolling load occurring when the leading end of the hollow shell S reaches the position of the rear end of the piercer plug 3 in the condition in which normal piercing-rolling is being performed, the ratio of the second threshold value of rolling to the above-described rolling load can be fixed in an arbitrary manner so long as a head jam fault can be detected.

REFERENCE SIGNS LIST

1*a*, 1*b* . . . Piercer roll
3 . . . Piercer plug
B . . . Billet

The invention claimed is:

1. A method of detecting a fault in piercing-rolling when a billet is piercing-rolled using piercer rolls and a piercer plug, the method comprising:

piercing-rolling the billet using the piercer rolls and the piercer plug;

measuring a rolling load parameter corresponding to a rolling load of the piercer rolls and a thrust load parameter corresponding to a thrust load of the piercer plug during the piercing-rolling step; and detecting a fault in piercing-rolling on the basis of the rolling load parameter value and the thrust load parameter value measured in the measuring step, wherein:

it is judged that a slippage fault in piercing-rolling has occurred in the case where the thrust load parameter value does not exceed a first threshold value of thrust, after the billet is gripped by the piercer rolls, by the time a first prescribed time elapses after the rolling load parameter value exceeds for the first time a first threshold value of rolling; and it is judged that a head jam fault in piercing-rolling has occurred in the case where the rolling load parameter value does not exceed a second threshold value of rolling, after the billet is gripped by the piercer rolls, by the time a second prescribed time elapses after the thrust load parameter value exceeds for the first time a second threshold value of thrust.

2. A method of producing a seamless pipe or tube by using piercing-rolling, comprising the steps of:

detecting a fault in piercing-rolling by the method according to claim 1; and improving conditions in piercing-rolling when the fault is detected.

* * * * *